US005288068A

United States Patent [19]

Roth

[11] Patent Number: 5,288,068

[45] Date of Patent: Feb. 22, 1994

[54] WORD GAME SYSTEM

[75] Inventor: Jules N. Roth, Aurora, Colo.

[73] Assignee: Way With Words, Inc., Englewood, Colo.

[21] Appl. No.: 390,401

[22] Filed: Aug. 4, 1989

[51] Int. Cl.[5] ..... A63F 3/00

[52] U.S. Cl. ..... 273/272; 273/153 R; 273/299; 434/177

[58] Field of Search ..... 273/153 R, 153 S, 272, 273/280, 284, 287, 299; 434/159, 160, 167, 171, 172, 177

[56] References Cited

U.S. PATENT DOCUMENTS

| | | | |
|---|---|---|---|
| 1,642,424 | 9/1927 | Massey | 273/153 R |
| 3,326,557 | 6/1967 | Berendt | 273/272 |
| 4,171,815 | 10/1979 | Sturtz | 273/284 |
| 4,591,161 | 5/1986 | Vanderhoof | 273/272 |

FOREIGN PATENT DOCUMENTS

| | | | |
|---|---|---|---|
| 2520626 | 8/1983 | France | 273/272 |
| 2093707 | 9/1982 | United Kingdom | 273/272 |
| 2203054 | 10/1988 | United Kingdom | 273/272 |

*Primary Examiner*—Vincent Millin
*Assistant Examiner*—William M. Pierce
*Attorney, Agent, or Firm*—Donald W. Margolis

[57] ABSTRACT

This puzzle game system utilizes a movable base frame 12 which defines within its body a cut-out template 26 which defines a crossed word pattern. The cut-out template 26 defines at least two intersecting word files 28, with each word file 28 being oriented at an angle to each other word file with which it intersects. A plurality of movable elements 14 which are size and shape to be received within the word files 28 are provided. Each element 14 has a display surface 18 for at least one symbol 16. To play the game, one edge of one word file 28 within base frame 12 is oriented cross-wise in front of the player and a plurality of symbol bearing movable elements 14 are provided which are at least sufficient to solve the puzzle. As a next step, base frame 12 is turned to orient one edge of a different word file 28 cross-wise in front of the player, and the puzzle is again solved. This process is continued until the base frame 12 has been solved in each of its edge orientations. Then, where the base frame 12 is three dimensional and two sided and is capable of being turned-over, the base frame 12 can be turned over, and the puzzle again solved for each edge orientation thereby providing twice as many different crossed word puzzles from a single frame 12.

48 Claims, 2 Drawing Sheets

WORD GAME SYSTEM

BACKGROUND OF THE INVENTION a) Field of the Invention

This invention relates to games and puzzles and to accessories for puzzles which are in the form of boards defining geometric patterns which are used with relatively movable elements. More specifically it relates to a board used in a game and to game pieces which are used to form words or equations with the board, but in which no predetermined or defined word or equation is required.

b) Discussion of the Prior Art

Word games are popular with the public. Common crossword puzzles are known wherein words are formed in either a defined or random matrix diagram by the player by completing definitions to a given vertical (down) column or horizontal (across) array of crossed words, hereinafter collectively referred to as "word files." Such crossword puzzle games provide a puzzle solver with clues in the form of a definition or synonym of each word in a specific or approximate "across" or "down" position of the puzzle. The puzzle solver must then determine what word corresponds with the given definition or synonym and is compatible with the word or words that is crosses, and then enter that word in the appropriate "across" word file or "down" word file in the puzzle. In order for such crossword puzzles to be operative, the player must find the already defined words, and has no discretion in forming words of his or her choice, or in playing the game in more than one way.

Another form of prior art word games, are anagrams. In playing anagrams, the game player usually reorders or transposes letters from one word or phrase to form another word or phrase. In one form of the game, players compete by selecting letters to form words of their choice, while in another form of the game they add one or more letters in sequence in a number of different directions to form words, the popular "Scrabble®" word game being one form thereof. In such games the player is not limited to defined words, and has substantial discretion in forming words of his or her choice, and may play the game in more than one way.

Other forms of relevant prior art word puzzle games are based on the word search or word hunt principle. Such games are currently offered so ubiquitously that they are approaching the omnipresence of crossword puzzles. In the known patent prior art, Massey, U.S. Pat. No. 1,642,424 utilizes the word search concept, in which a puzzle is comprised of a plurality of continuous rows of letters which are printed on a sheet and arranged in a manner which is at first glance meaningless. Intermingled among the letters are words. As an aid to finding those words, a stencil or template having an opening corresponding in size and form to the spaces occupied by the words is provided. In a related invention, DeLano, U.S. Pat. No. 4,595,203, provides a puzzle reading device made from a movable plate having a number of intersecting windows for use with a word search puzzle. The puzzle reading device helps to make words which are hidden in the horizontal, vertical or diagonal rows of the word search puzzle more readily identifiable. In both of these references, and in word search and word hunt games generally, the player must find the already existing words, and has no discretion in forming words of his or her choice, or in playing the game in more than one way.

In other prior art patents, Withington, U.S. Pat. No. 1,282,513, teaches a puzzle in which a sentence on a sheet is provided, which includes a movable partition having a slot formed within it for receipt of the number of letters necessary to spell a specific missing word to complete a specific quotation or phrase. Similarly, James, U.S. Pat. No. 4,185,830, discloses a game apparatus wherein a base is provided with a plurality of rows of letters and punctuation at fixed locations and is utilized with a template and a number of letter carrying elements to form a predetermined sentence or phrase. In both of these references, the player must find only specific words or phrases, and has no discretion in forming words of his or her choice, or in playing the game in more than one way.

Mitchell, U.S. Pat. No. 2,050,498, discloses a crossword board divided into squares, and in which alphabetical indicators and key numeral indicators can be utilized in developing the complete solution for a diagramless puzzle, or, in the alternative, for use in developing a new crossword puzzle. It is noted, that there is no specific template taught by this reference. Kelly, U.S. Pat. No. 2,517,115, discloses a crossword puzzle book in which a pad of crossword puzzle solution blank leaves are located on a page with the definitions for solving that puzzle, so that more than one player can solve the puzzle on a single leaf of the pad without receiving any clues from previous players, and without giving clues to subsequent players as to the solution. While this allows the game to be played by more than one player, or for a single player to play it more than once, as with any crossword puzzle, each time that it is played the player must find the correct defined words and has no discretion in forming words of his or her choice, or in playing the game in more than one way.

Larroca, U.S. Pat. No. 2,782,530, discloses a crossword puzzle structure which is comprised of a frame for receiving a sheet of paper and a movable masking sheet for location above the sheet which allows a variety of puzzle constructions to be produced and developed. Freedman, U.S. Pat. No. 2,586,017, provides a cover for use with a number of games, including crossword puzzles, in which a transparent material having a pressure sensitive face is placed over the game to receive indications of game pieces or words.

It is thus seen that it would be desirable to provide a novel word game or puzzle wherein no predetermined word is required or defined, and in which the player may construct a multitude of puzzle solutions in a predetermined yet variable matrix frame, without requiring any directions or clues. It would also be desirable to provide such a novel game or puzzle, wherein there are many variable modes of play, and in which the degree of difficulty of the puzzle may be varied by the player.

SUMMARY OF THE INVENTION

In view of the foregoing, it is an object of the present invention to provide a novel word game or puzzle wherein no predetermined words are required or need be defined.

It is another object of the present invention to provide such a novel word game or puzzle in which the player may construct a multitude of puzzle solutions without requiring any directions or clues as to their solution.

It is another object of the present invention to provide such a novel word game or puzzle system which uses a base frame which defines a template of crossed word files which can be solved by a player using movable letter bearing elements.

Another object of the present invention is to provide such a system which is simple in construction and design, and yet which lends itself to numerous modes of play.

It is yet another object of the present invention to provide a simple, inexpensive word game or puzzle system wherein there are many variable modes of play, and in which the degree of difficulty may be varied by the player.

The foregoing objects of the present invention are obtained by providing a puzzle game apparatus and methods of playing the same which utilize as a key element a movable base frame which carries and defines a cut-out crossed word pattern template which defines at least two word files, and in which the word files overlap one another, having at least one common space, and are at an angle to one another. In preferred embodiments the base frame is a right angle parallelogram in shape and has four edges, and each word file is oriented substantially parallel to at least one of the outer edges of the frame. Regardless of whether the base frame is a right angle parallelogram, each word file has an upper and a lower edge which may be used to orient the game, as described in greater detail below. A plurality of uniformly sized movable elements are provided for use within the cut-out template of crossed word files. Each movable element has a display surface for at least one letter or symbol. As explained below, no predetermined words are required or need be defined in order to play the game, and no directions or clues as to the solutions are required.

From another perspective, the system of the present invention may be perceived to be comprised of a base which carries a cut-out template which defines overlapping word files for receipt of movable uniformly sized letter bearing elements, wherein, in preferred embodiments an edge of each word file is capable of being oriented viz a viz the player.

In the preferred play mode of the present invention, the base frame is a right angle parallelogram in shape, for example a square or a rectangle having four outer edges, and each of the word pattern files defined by the frame is a rectangle which is parallel to a pair of opposed parallel outer edges of the base. The preferred base frame will carry and define at least as many word files as there are outer edges of the base frame, and each word file will require a different number of movable elements to fill it, thereby substantially assuring that the crossed word pattern will not be symmetrical within the base frame.

For reasons which are explained in greater detail below, in such preferred embodiments there are at least as many word files as there are edges of the base frame, and each word file requires a different number of movable elements to fill and solve it. Also, in preferred embodiments the cut-out template is not symmetrical within the base frame, and the base frame is three dimensional and two sided, and is capable of being turned-over. As detailed below, the use of a movable two sided frame allows for multiple orientations of the base frame, and therefore multiple modes of play and multiple solutions using a single base frame.

Where the base frame is not a polygon, or where the word files are not parallel to the edges, the edges of the word files within the base frame can serve to orient the frame in front of the player. In such systems, the movable base frame can be turned to orient different edges of different word files cross-wise or vertically in front of a player to allow the puzzle to be solved, in various orientations. In any event, no predetermined words are required to need be defined in order to play the game, and no directions or clues as to the solutions are required.

To play the game, any outer edge of the base frame or the edge of a word file is oriented cross-wise or perpendicular in front of a player, and a plurality of letter bearing movable elements are provided. The number of letter bearing movable elements which are provided are at least sufficient to solve the puzzle in this first orientation, and at least equal to the total number of letter spaces defined by all of the word files. "Solving" the puzzle consists of completely filling each and every word file with letter bearing movable elements which together form any complete valid word in that file. "Valid" words may be defined by either table rules or by reference to any standard dictionary or reference work. Unlike a conventional crossword puzzle, definitions of the words to be placed in the word files are not required and need not be provided, although the use of definitions for the different word files is within the purview of the present invention.

As a next step, the base frame is turned to orient a different outer edge or edge of a word cross-wise or perpendicular in front of a player in a "second orientation", and the puzzle is again solved by filling each word file with letter bearing movable elements to create a valid word. This process can be, and should be, continued until the base frame has been solved in each of its edge orientations, i.e. for a quadrilateral frame in which the word files are parallel to the edges of the base frame that would require four solutions. As a further extension of the process, where the base frame is three dimensional and two sided and is capable of being turned-over, after all of the solutions on one side are completed, the base frame can then be turned over, and the puzzle again solved by filling each word file with letter bearing movable elements to create a valid word for each edge orientation, thereby providing a total of at least eight crossed word puzzles from a single frame. Where the cut-out template is not symmetrical within the frame the crossed word file pattern will be different for each orientation, and so every solution will, of necessity, be different.

As described in greater detail below, other modes of play are possible in which a single base frame and even a minimum number of movable letter elements can provide a very large number of playing situations at various skill levels. The degree of difficulty of the puzzle may be varied by varying the complexity of the cut-out template or by limiting the number or type of letters which are available for use in solving the crossed word puzzle in its various orientations. The present invention also allows for a scenario in which several solvers, using the exact same frame, in the exact same orientation, and with the exact same letters on movable elements, each construct valid solutions, but with the possibility of individual solutions which may differ from solutions made by other players.

While it is clear that the present invention would be attractive to persons who enjoy crossword puzzles, it also has appeal for persons who enjoy word search or word hunt games. It extends the principle of word search or word hunt games, on increment by challenging the solver to engage in a "solution hunt," or a "search for solutions," or a "crossword quest," thus utilizing many of the skills and techniques, as well as the satisfaction of those games. However, it also digresses in an interesting way from those games by allowing more creativity than their current formats which establish one and only one correct solution.

These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
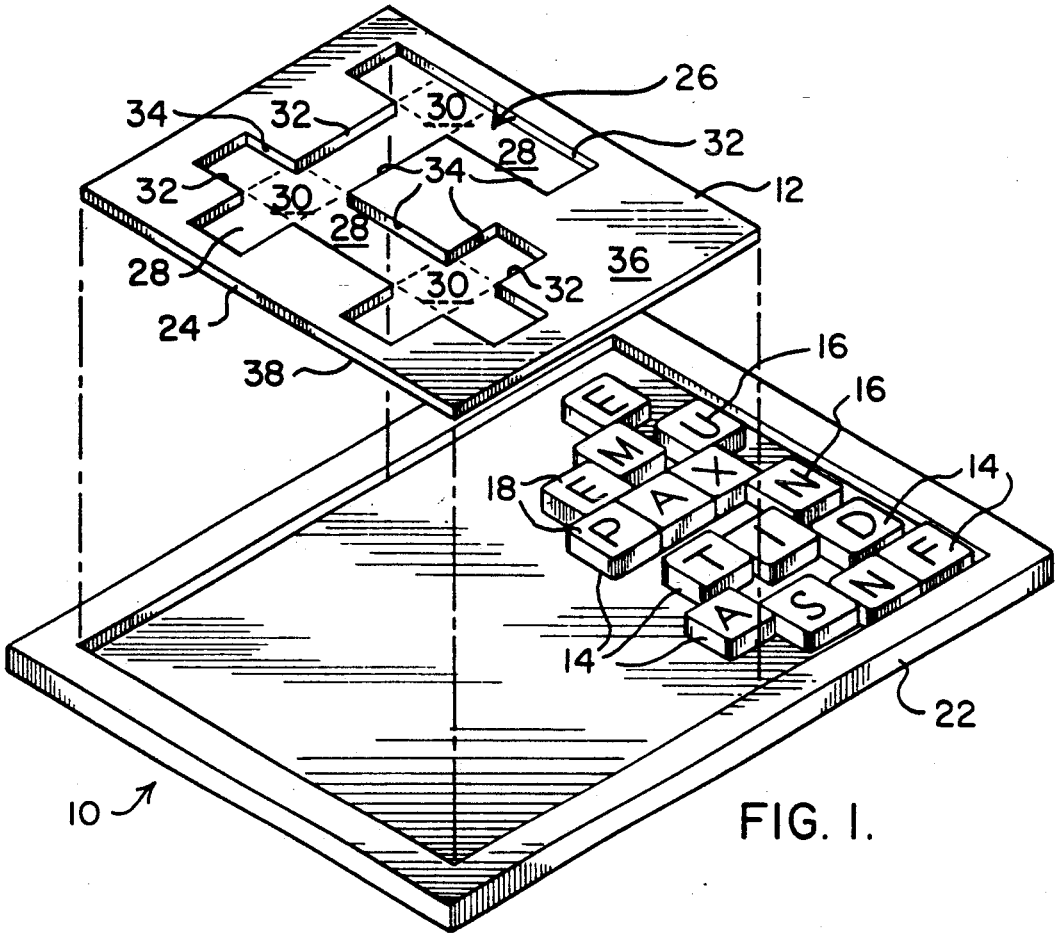
FIG. 1 is an exploded perspective view, showing a three dimensional and two sided base frame carrying a cut-out template and a number of three dimensional movable letter carrying elements shown in relation to a tray for conveniently holding the base frame and letter carrying elements for play according to the present invention.

Like numbers refer to like parts in the various figures. Referring to FIG. 1, there is shown a perspective view of the puzzle game system of the present invention, generally 10, including a base frame 12 and a plurality of uniformly sized movable elements 14, each of which carries a letter or symbol 16 on its display surface 18. In FIG. 1, base frame 12 and movable elements 14 are shown in relation to an optional support tray 20 having borders 22 which hold and retain them, according to one embodiment of the system of the present invention.

The key element of the puzzle game system of the present invention is base frame 12. As shown most clearly in FIG. 1, base frame 12 is polygonal, having a plurality of outer edges 24, and defines within its body a cut-out crossed word file template 26. The cut-out crossed word file template 26 defines at least two word files 28. Each word file 28 overlaps at least one other word file 28. Wherever word files 28 overlap one another they have a space 30 which is common to both word files 28. Each overlapping pair word files are at an angle to one another. In the embodiments shown, base frame 12 and 112 are right angle parallelograms, a rectangle and a square, respectively, having four outer edges 24, and each of the word files 28 defined by the cut-out template carried by the frame is a rectangle which is parallel to a pair of opposed parallel outer edges 24 of base 12 or 112. Each word file 28 also has a pair of parallel edges 32 and 34.

Referring again to FIG. 1, a plurality of uniformly sized movable elements 14 are provided for use within the cut-out template 26. Each movable element 14 is of a size and shape such that it is adapted to be received snugly between edges 32 and 34 of any word file 28 of cut-out template 26. Each movable element 14 is also of a size and shape such that some whole number of the movable elements 14, when placed linearly within any word file 28 are adapted to substantially fill that file. As previously noted, each movable element 14 has a display surface 18 which carries at least one letter or symbol 16.

Described from another perspective, cut-out template 26 includes overlapping word files 28 for receipt of uniformly sized elements 14, with each word file 28 capable of being oriented with one or both of its edges 32 and 34 substantially parallel to or perpendicular to the position of a player, not shown.

For reasons which are explained below, in the preferred embodiments of the present invention base frame 12 is a right angle parallelogram which carries at least as many word files 28 as there are outer edges 24, and each word file 28 requires a different number of movable elements 14 to fill it. This results in a cut-out template which is not symmetrical within base frame 12. Also, in preferred embodiments base frame 12 is movable, three dimensional and two sided and is capable of being turned-over. As indicated, for example in FIGS. 2A–2H and FIGS. 4A–4H, base frame 12 and 112 have first sides 36 and 136, and second sides 38 and 138, respectively. As discussed below, it is also both attractive and practical to number or name each orientation so that a player will have no difficulty in identifying which orientations he or she has solved or has yet to solve.

In the preferred play mode, for example in FIGS. 2A–2H and FIGS. 4A–4H, base frame 12 and 112 are a rectangle and a square, respectively, each having four outer edges, and with each of the word files 28 or 128 carried and defined by the frame being parallel to one of the pairs of opposed parallel outer edges. The preferred base frames 12 and 112 define at least as many word files 28 and 128 as there are edges of the base frame, in this case at least four, and each specific word file 28 or 128 will require a different number of movable elements 14 to fill it. For example, the four word files 28 and 128 shown in FIGS. 2A–2H and FIGS. 4A–4H, require three, four, five and six moveable elements, respectively to fill them. As a result, as frames 12 and 112 are turned to each of their respective four orientations "1st", "2nd", "3rd", and "4th" on side 36, and four orientations "5th", "6th", "7th", and "8th" on side 38; and to their four orientations "A", "B", "C", and "D" on side 136, and four orientations "E", "F", "G", and "H" on side 138, the cut-out template pattern presented to the player is different for each orientation. It is thus seen that such a mixture of different sized word files 28 and 128 assure that the cut-out template will not be symmetrical within base frames 12 or 112.

Figure 2A:
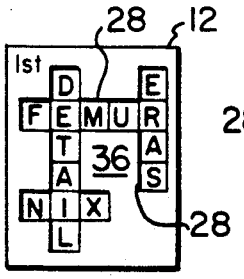
FIGS. 2A through 2H are reduced schematic top plan views of the base frame device of FIG. 1, showing the frame and its cut-out template sequentially in its eight possible orientations, with each orientation showing a different crossword solution, with each solution using the same group of fifteen letters shown in FIG. 1.
Figure 2B:
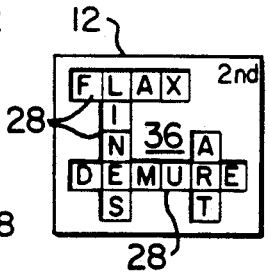
Figure 2C:
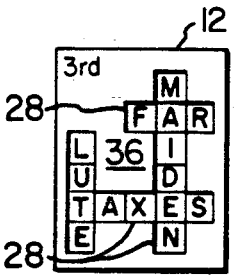
Figure 2D:
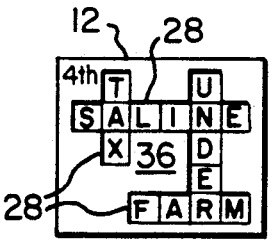
Figure 2E:
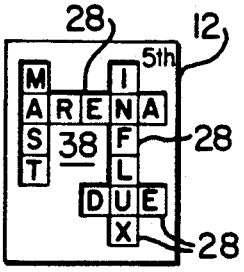
Figure 2F:
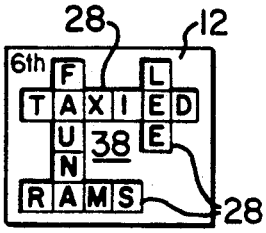
Figure 2G:
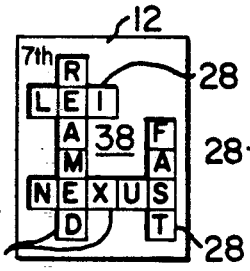
Figure 2H:
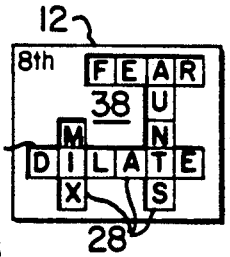

To play the game, any outer edge 24 of base frame 12 is oriented cross-wise in front of the player with side 36 on top in what will be referred to as the "1st" orientation, for example, that shown by FIG. 2A, and a plurality of movable elements 14, each bearing a letter 16 are provided. The number of movable elements 14 which are provided are at least sufficient to solve the puzzle in this 1st orientation, and therefore at least equal to the total number of element spaces defined by all of the word files 28 in cut-out template 26. As indicated previously, "solving" the puzzle consists of completely filling each and every word file 28 with letter bearing movable elements 14, which letter bearing movable elements 14 together form any complete valid word in that file, including the common letters 30 of each overlapping word file 28. To play the game, no predetermined words are required or need be defined, and no directions or clues as to the solutions are required.

As a next step, the base frame 12 is turned to orient a different outer edge 24 cross-wise in front of the player in a "2nd" orientation, for example, that shown by FIG. 2B, and the puzzle is again solved by filling each word pattern file 28 with a valid word. This process can be, and should be, continued until the base frame 12 has been solved in each of its other orientations "3rd" and "4th". It is thus seen that quadrilateral frame 12 is possible of having at least four different orientations and four different solutions.

As a further extension of the process, where base frame 12 is three dimensional and two sided and is capable of being turned-over, the base frame 12 can then be turned over so that second side 38 is on top. Then with second side 38 on top, the puzzle can be solved again by filling each word file 28 with a valid word for each new outer edge 24 orientation. So, for example, for a quadrilateral frame 12 that has been turned over that would require an additional four solutions, "5th", "6th", "7th", and "8th" on side 38 as illustrated by FIGS. 2E–2H, respectively, thereby providing a total of at least eight crossed word puzzles from a single frame 12. As noted above, where the cut-out template 26 is not symmetrical within frame 12 will be different for each of the eight orientations, and so every solution will, of necessity, be different.

In the play of the games taught by the present invention, "valid" words may be defined by either table rules or by reference to any specific standard dictionary or reference work. However, unlike a conventional crossword puzzle, definitions of the words to be placed in word files 28 are not required and need not be provided, although the use of definitions for the different word files 28 is certainly within the teaching of the present invention.

As suggested above, frame 12 may be supplied to the player with a large assortment of movable letter bearing elements 14 available for solving each orientation of frame 12. In yet another method of play, frame 12 may be supplied with one solution in place, and then only the moveable letter bearing elements 14 of that given solution may be used to solve the other orientations of frame 12. In one preferred mode of play, as illustrated by FIGS. 2A through 2H, each of the eight orientations of the puzzle game are solved using the same assortment of fifteen movable elements 14 shown in FIG. 1, and without repeating any word.

In another manner of play, the assortment of movable elements 14 may be selected by the player in a manner such that his or her first solution to the puzzle in the first orientation from a large assortment of movable elements 14 provides the selection of movable letter bearing elements 14 which are then used with the other orientations of the puzzles. This latter method of play causes the player to define his or her own "challenge." As already noted, in one mode of play, each of the puzzles are solved without repeating any word from one puzzle to another. Of course, the foregoing and other modes of play can be combined so that, for example, the same assortment of movable elements 14 are used for every puzzle in the same frame 12 without repeating the same word in any two puzzles. In each of these variations, no predetermined words are required or need be defined in order to play the game, and no directions or clues as to the solutions are required.

It will be apparent that a player of even slight skill will be able to provide more than one solution for the word files 28 of cut-out template 26 defined by base frame 12 in each of its orientations. It is therefore seen that a single base frame 12 and even a limited number of movable letter bearing elements 14 can provide a very large number of playing situations. The present game also provides any number of opportunities for competition between players, or for use with specific word themes. Tally sheets may be provided to keep track of a players puzzle solutions.

Figure 3:
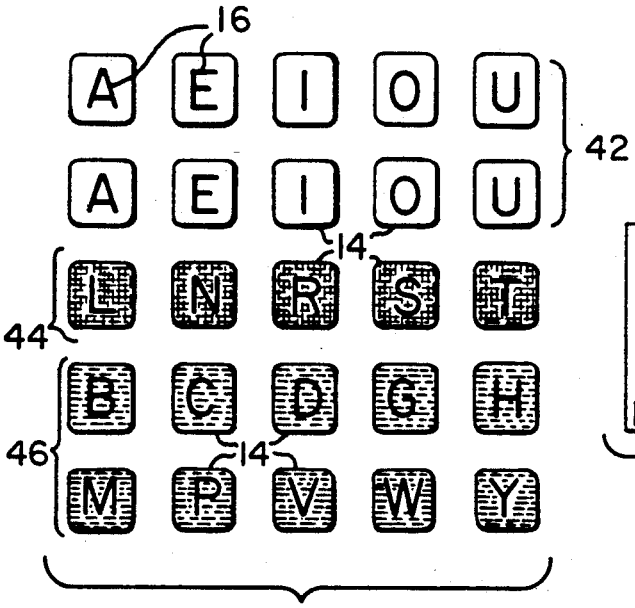
FIG. 3 is an enlarged plan view, showing a number of three dimensional movable elements in coded groupings according to the type of letter which they carry for use in certain modes of play of the present invention.

FIG. 3 shows several groups of letter elements 14. One group, for example vowels 42 are repeated twice, and are white. A second group, for example the most commonly used consonants 44, are shaded to indicate the color code yellow. A third group, for example ten less commonly used consonants 46, are shaded to indicate the color code grey. Another less commonly used group of six vowels, "F", "J", "K", "Q", "X", and "Z", are not present at all in the groups shown in FIG. 3, but could be present if desired. In the use of such color coded or otherwise coded groups of letters, a player solving a puzzle having a given number of spaces in cut-out template 26, say enough to receive fifteen letter bearing movable elements 14, could place the coded element groups 42, 44 and 46 symbol side down, so that their letter symbols 16 are not visible. As a form of challenge, in the play of the game the player could then select a pro rata distribution of elements 14 carrying unknown symbols 16 from each group. For example, where there are fifteen spaces in cut-out template 26, five color coded elements 14 from each of group 42, 44 and 46 could be selected, and the player would then be limited to solving the puzzle in each of its orientations using only those randomly selected letters. Because of the manner that the symbols 16 have been distributed in FIG. 3, this somewhat random selection of letter bearing elements 14 should be sufficient to solve virtually any cut-out template 26 in any of its orientations. Of course, other coded groupings of letters could be used, or more than the bare minimum of coded elements could be selected.

As already suggested, this coded mode of play can be combined with other modes of play, so that, for example, an assortment of color coded movable elements 14 exactly equal to the number of elements required to fill the cutout template 26, and then, only those selected movable elements 14 are used to solve every puzzle orientation in the same frame 12 without repeating the same word in any two puzzles. Once again it is noted that no predetermined words are required or need be defined in order to play this variation of the game, and no directions or clues as to the solutions are required.

Referring to FIGS. 4A–4H, a three dimensional, movable frame 112 is shown which has a different cut-out template than frame 12. However its cut-out template is also adapted to receive fifteen letter elements 14. Like frame 112, it also has four orientations "A", "B", "C", and "D" on its first side 136, as shown by FIGS. 4A–4D; and four orientations "E", "F", "G", and "H" on its second side 138, as shown by FIGS. 4E–4H. It will be seen that the cut-out template presented to the player is different for each of the four orientations on first side 136, and also for each of the four orientations, 4E–4H on its second side 138. It is also noted that in all eight orientations of frame 112 shown in FIGS. 4A–4H of this puzzle are also solved using the same fifteen letters and without repeating any word. As in the other versions, no predetermined words are required or need be defined in order to play the game using base 112, and no directions or clues as to the solutions are required.

Figure 5:
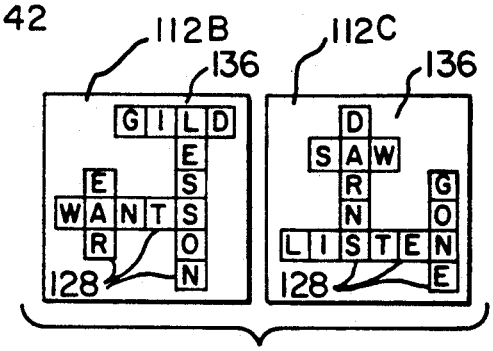
FIG. 5 shows a version of play of the present invention in which more than one three dimensional base frame device of the present invention are located and played simultaneously side-by-side.
Figure 4A:
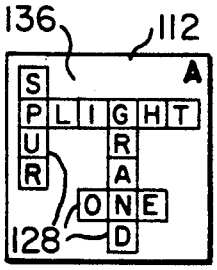
FIG. 4A through 4H are schematic top plan views of a different three dimensional base frame of the present invention showing a frame having a different cut-out template sequentially in its eight possible orientations, with each different orientation in each figure showing a different solution using the same fifteen letters.
Figure 4B:
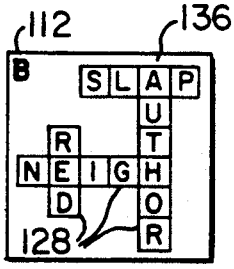
Figure 4C:
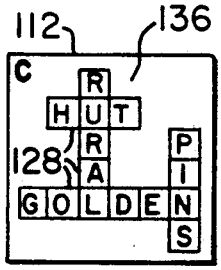
Figure 4D:
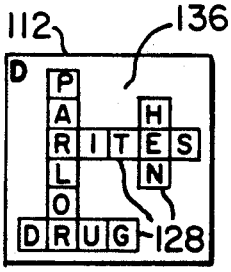
Figure 4E:
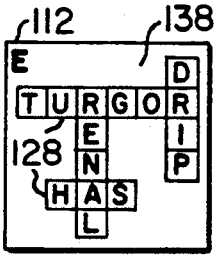
Figure 4F:
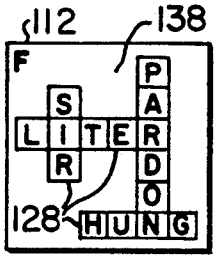
Figure 4G:
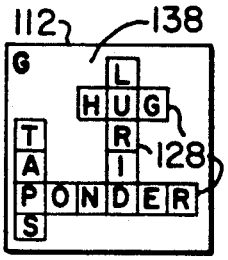
Figure 4H:
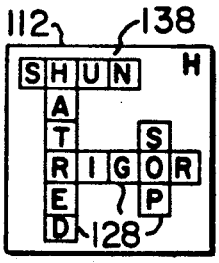

FIG. 5 shows a solved version of play of the present invention in which more than one movable, three dimensional base frame 112B and 112C of the present invention are located and played side-by-side and simultaneously. As illustrated, frames 112B and 112C are both the same as frame 112 shown in FIGS. 4A–4H, and specifically correspond to the orientations of FIGS. 4B and 4C, respectively. FIG. 5 illustrates a method of play of the puzzle game of the present invention, in which two or more frames can be solved simultaneously, perhaps using the same thirty letters for all orientations. The solution shown happens to use the same fifteen letters to solve each frame 112B and 112C. For two three dimensional frames 112B and 112C, as shown, this introduces the possibility of sixty four different orientation arrangements, and therefore of at least sixty four different games, i.e. each eight orientations of frame 112B with each eight orientations of frame 112C. Clearly, with this large number of variations no predetermined words are required or need be defined in order to play the game, and no directions or clues as to the solutions are required.

In a further method of play of the puzzle game of the present invention, each frame 12 or 112 can be solved in more than one way in a single orientation, and even using the same letters. As a matter of fact, the frame in the orientation of FIG. 2A, using the fifteen letters shown, has been solved at least sixty-four different ways, and without repeating any word.

Other variations of the game of the present invention include couplable, expandable or modifiable base frames. It is also possible to play the game using equivalent numbers, and mathematical symbols, for example to form equations. Also included are variations in which the base frame has shapes other than right angle parallelograms in which each word file is oriented substantially parallel to at least one of the edges of the frame. That is, the base frame may have other polygonal shapes in which each word file is or is not oriented substantially parallel to at least one of the edges of the frame. For example, a hexagonal base frame having six word files with a single common letter, and in which each word file is oriented substantially parallel to at least one of the edges of the hexagonal frame provides a game in which the solutions are the equivalent of one form of word search or word hunt game. Non-polygonal shaped frames, such as circles, ellipses, or random shapes can also be used in the play of the game. Regardless of the shape of the base frame or the orientation of the word files viz a viz the edges of a polygonal frame, each word file has an upper and a lower edge which may be used to orient the frame horizontally or vertically to the player for multiple positions of play.

It is therefore seen that the present invention provides a novel word game or puzzle in which a player may construct a multitude of puzzle solutions in a predetermined movable three dimensional base frame, carrying a cut-out template using movable letter or symbol bearing elements, and wherein no predetermined words are required or need be defined in order to play the game, and without requiring any directions or clues as to the solutions. The system provided is inexpensive, simple in construction and design, and yet lends itself to numerous and variable modes of play, in which the degree of difficulty may be varied by the player.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

What is claimed is:

1. An apparatus for a puzzle game system for a player including a board which is used with relatively movable symbol bearing elements, and for which no predetermined solutions and no clues as to the solutions are required in order to play the game in two or more playing positions, wherein the apparatus comprises:

a board having a fixed three dimensional base frame body having a top side and a bottom side, and which is capable of being turned to place either said top side up or said bottom side up into a playing position orientation, which body defines and carries a fixed cut-out template which is comprised of two or more fixed cut-out word files which intersect with one another, with each said fixed word file being oriented at an angle to each other said fixed word file with which it intersects, each said fixed word file having a pair of opposed top and bottom longitudinal edges, each said fixed word file top longitudinal edge and bottom longitudinal edge also defining a different playing position orientation, whereby said fixed base frame is adapted to be moved to orient said fixed cut-out template to two or more playing position orientations; and a plurality of symbol bearing movable elements which are sized and adapted for use within said fixed cut-out template of intersecting fixed word files; whereby, by selecting some of said symbol bearing movable elements and placing them in oriented positions in said word files for two or more playing position orientations a player can develop an oriented solution to said puzzle for each of two or more different playing position orientations of said fixed template carried by said fixed base frame, all without any required predetermined or defined words or clues as to the solutions.

2. The puzzle game apparatus of claim 1, wherein said base frame is a polygon having a number of outer edges.

3. The puzzle games apparatus of claim 2, wherein said base frame defines and carries at least one word file which is parallel to each outer edge of said base frame.

4. The puzzle game apparatus of claim 2, wherein said base frame is a right angle parallelogram having four outer edges.

5. The puzzle games apparatus of claim 4, wherein said base frame defines and carries at least one word file which is parallel to each outer edge of said base frame.

6. The puzzle game apparatus of claim 4, wherein said base frame is a rectangle.

7. The puzzle game apparatus of claim 4, wherein said base frame is a square.

8. The puzzle game apparatus of claim 4, wherein said base frame has two pairs of opposed parallel outer edges, and in which each said word file which is defined and carried by said base frame is oriented substantially parallel to at least one of said pairs of parallel outer edges of said base frame, and wherein further, each said word file is substantially at right angles to each other said word file with which it intersects.

9. The puzzle game apparatus of claim 8, wherein said base frame carries and defines at least as many word files as there are outer edges of said base frame.

10. The puzzle game apparatus of claim 9, wherein each said word file will require a different number of movable elements to fill it.

11. The puzzle game apparatus of claim 10, wherein said base frame is three dimensional, has a first side and a second side, and is capable of being turned to place either said first side up or said second side up into a playing position.

12. The puzzle game apparatus of claim 1, wherein said cut-out template carried and defined by said base frame is not symmetrical.

13. The puzzle game apparatus of claim 1, wherein substantially each of said movable elements has one display surface which bears one letter symbol.

14. The puzzle game apparatus of claim 13, wherein said letter bearing movable elements are substantially uniformly sized.

15. The puzzle game apparatus of claim 14, wherein said uniformly sized letter bearing movable elements are sized and shaped such that some whole number of said movable elements are adapted to substantially fill each said word file.

16. The puzzle game apparatus of claim 1, wherein substantially all of said plurality of movable elements has a display surface which bears one symbol, and wherein further said movable elements are coded into groups based on the symbols which they bear.

17. The puzzle game apparatus of claim 16, wherein the coding of said movable elements is color coding.

18. The puzzle game apparatus of claim 1, wherein each said elongated word file is substantially rectangular, and wherein further, said opposed longitudinal edges included in said word files are substantially parallel to one another.

19. The puzzle game apparatus of claim 1, wherein a tray is provided for said base frame and for said plurality of movable elements.

20. The method of playing a puzzle game system for which no predetermined solutions and no clues as to the solutions are required in order to play the game, said puzzle being comprised of a fixed three dimensional base frame body having a first side and a second side, and is capable of being turned to place either said first side up or said second side up into a playing position orientation, which body defines and carries a fixed cut-out template which is comprised of two or more fixed word files which intersect with one another, with each said fixed word file being oriented at an angle to each other said fixed word file with which it intersects, each said word file being elongated and having a pair of opposed top and bottom longitudinal edges, each said fixed word file top edge and bottom edge also defining a different playing position orientation, whereby said fixed base frame is adapted to be moved to orient said fixed cut-out template to two or more playing position orientations; and a plurality of symbol bearing movable elements which are sized and adapted for oriented use within said fixed cut-out template of intersecting word files, including the steps of:

orienting said fixed base frame in a first orientation playing position;

selecting and placing an assortment of said symbol bearing movable elements in oriented positions in said fixed word files to attempt to develop an oriented solution to said puzzle for said first playing position orientation of said fixed base frame;

orienting said fixed base frame in at least a second playing position; and then selecting and placing an assortment of said symbol bearing movable elements in oriented positions in said fixed word files to attempt to develop an oriented solution to said puzzle for said second playing position orientation of said fixed base frame; all without any required predetermined or defined words or clues as to the solutions in any orientation.

21. The method of claim 20 wherein the process of orienting one of the said edges of the various said word files, providing symbol bearing movable elements, and attempting to solve said puzzle in such various orientations of said base frame is continued.

22. The method of claim 20 wherein said base frame defines only word files which are substantially at right angles to one another, thereby limiting the process of playing the game to a maximum of eight word edge orientations for which four different base frame orientations are possible.

23. The method of claim 20, wherein said base frame is a right angle parallelogram having four outer edges, and wherein further, each word file is substantially parallel to a pair of said outer edges, thereby limiting the process of playing the puzzle game to a maximum of eight different base frame orientations.

24. The method of claim 20, wherein more than one solver attempts to solve identical base frame cut-out templates which have been placed in the exact same orientation, and with identical letters on movable elements.

25. The method of claim 20, wherein definitions or clues are provided to the player for said different word files in one or more orientation of said base frame.

26. The method of claim 20, wherein said base frame is supplied to the player with an assortment of movable letter bearing elements available for solving all of the possible orientations of said frame.

27. The method of claim 20, wherein said base frame is supplied with moveable letter bearing elements in place in said word files to provide one solution for one orientation of said base frame, and then using only said supplied moveable letter bearing elements of that given solution to attempt to solve the other orientations of said base frame.

28. The method of claim 20, wherein attempts to solve all of the orientations of said base frame are made using the same assortment of symbol bearing moveable elements.

29. The method of claim 28, wherein the attempts to solve all of the orientations of said base frame are made using the same assortment of symbol bearing moveable elements without repeating the same word in any two puzzle orientations.

30. The method of claim 20, wherein attempts to solve said puzzle are made using an assortment of letter bearing moveable elements which are selected by the player from an assortment of symbol bearing moveable elements in attempting to make a first solution to said puzzle in a first orientation of said base frame, to thereby provide a selection of symbol bearing moveable elements which are then used to attempt to solve all of the other orientations of said base frame.

31. The method of claim 30, wherein attempts to solve said puzzle are made using the same assortment of symbol bearing moveable elements for every puzzle orientation of the same frame without repeating the same word in any two puzzle orientations.

32. The method of claim 20, wherein attempts are made to provide more than one solution for a single orientation of said base frame.

33. The method of claim 32, wherein said attempts to provide more than one solution for each orientation of said base frame are made using only the same letter bearing moveable elements.

34. The method of claim 20, wherein the attempts to solve said puzzle are made using coded groups of letter bearing movable elements.

35. The method of claim 34, wherein said attempts to solve said puzzle using coded groups of letter bearing movable element includes a step in which the player selects a given number of said coded elements without any knowledge as to what letters they carry.

36. The method of claim 35, wherein the number of said coded groups of letters selected by the player are exactly equal to the number of said moveable element which are required to fill all of said word files of said cut-out template.

37. The method of claim 35, wherein their are two or more groups of coded moveable elements, and the player selects a pro rata distribution of coded elements from each group of coded elements.

38. The method of claim 35, wherein the player is limited to selecting an assortment of said coded letter bearing moveable elements exactly equal to the number of said movable elements required to fill said cutout template, and then using only those said selected symbol bearing moveable elements to attempt to solve all base frame orientations without repeating the same word in any two puzzle orientations.

39. The method of claim 34, wherein said coded groups of letter bearing elements are selected from the groups consisting of vowels, commonly used consonants, and less commonly used consonants.

40. The method of claim 34, wherein said coded groups are color coded, thereby providing a method of playing the puzzle game by selecting groups of letter bearing movable elements based on their color.

41. The method of claim 40, wherein the player is limited to solving said puzzle in each of the possible orientations of said base frame using only the selected coded elements letters.

42. A board apparatus used in a game for a player in which symbol carrying relatively movable elements are used to form words or equations with the board, and for which no predetermined solutions and no clues as to the solutions are required in order to play the game, wherein the apparatus comprises:

a board having a fixed three dimensional base frame body having a first side and a second side, and is capable of being turned to place either said first side up or said second side up into a playing position orientation, which body defines and carries a fixed cut-out template which is comprised of two or more fixed word files which intersect with one another, with each said word file being oriented at an angle to each other said fixed word file with which it intersects, each said fixed word file having a pair of opposed top and bottom longitudinal edges, each said fixed word file top edge and bottom edge also defining a different playing position orientation, whereby said fixed base frame is adapted to be moved to orient said fixed cut-out template to two or more playing position orientations; whereby, by selecting some of said symbol bearing movable elements which are adapted to be received within said fixed word files, and placing them in oriented positions in said fixed word files for two or more playing position orientations a player can develop an oriented solution to said puzzle for each of two or more different playing position orientations of said fixed base frame, all without any required predetermined or defined words or clues as to the solutions.

43. The puzzle game apparatus of claim 42, wherein each said word file is substantially at right angles to each other said word file with which it intersects.

44. The method of playing a puzzle game system for which no predetermined solutions and no clues as to the solutions are required in order to play the game, said puzzle being comprised of a three dimensional base frame body having a first side and a second side, and is capable of being turned to place either said first side up or said second side up into a playing position orientation, which body defines and carries a cut-out template which is comprised of two or more fixed word files which intersect with one another, with each said word file being oriented at an angle to each other said word file with which it intersects, each said word file having a pair of opposed top and bottom longitudinal edges, each said word file top edge and bottom edge also defining a different playing position orientation, whereby said base frame is adapted to be moved to orient said cut-out template to two or more playing position orientations; and a plurality of symbol bearing movable elements which are sized and adapted for oriented use within said cut-out template of intersecting word files, including the steps of:

placing two or more of said base frames in a first playing position orientation;

attempting to solve said two or more movable base frames by selecting and placing said symbol bearing movable elements in oriented position in said word files in each of said two or more movable base frames to attempt to simultaneously develop an oriented solution to said puzzle for said first playing position orientation of each said two or more movable base frames;

placing said two or more base frames in at least a second playing position orientation; and then attempting to solve said two or more movable base frames in said second playing position orientation by selecting and placing said symbol bearing movable elements in oriented positions in said word files in said two or more movable base frames to attempt to substantially simultaneously develop a solution to said puzzle for said second playing position orientation of each said two or more movable base frames to attempt to simultaneously develop a solution to said puzzle for said second playing position orientation of said base frame; all without any required predetermined or defined words or clues as to the solutions in any orientation.

45. The method of claim 44, wherein a pair of said base frames are provided to a player.

46. The method of claim 44, wherein the player is limited to solving said two or more base frames in each of the combined orientations of said base frames using a limited selection of letter bearing movable elements.

47. The method of claim 46, wherein said selection of letter bearing movable elements which are provided is limited to equal the total number of movable element receiving spaces defined by said two or more base frames.

48. The method of playing a puzzle game system for which no predetermined solutions and no clues as to the solutions are required in order to play the game, said puzzle being comprised of a three dimensional base frame body having a first side and a second side, and is capable of being turned to place either said first side up or said second side up into a playing position orientation, which body defines and carries a cut-out template which is comprised of two or more fixed word files which intersect with one another, with each said word file being oriented at an angle to each other said word file with which it intersects, each said word file having a pair of opposed top and bottom longitudinal edges, each said word file top longitudinal edge and bottom longitudinal edge also defining a different playing position orientation, whereby said base frame is adapted to be moved to orient said cut-out template to two or more playing position orientations; and a plurality of movable elements which are sized and adapted for oriented use within said cut-out template of word files, including the steps of:

orienting said base frame in a first playing position so that one longitudinal edge of at least one said word file is either cross-wise or perpendicular to what would be the location of the player;

selecting and placing said symbol bearing movable elements in oriented positions in said word files to attempt to develop an oriented solution to said puzzle for said first playing position of said base frame orientation;

orienting said base frame in at least a second playing position so that one longitudinal edge of the same or of a different word file is either cross-wise or perpendicular to what would be the location of the player; and then selecting and placing said symbol bearing movable elements and placing them in positions in said word files to attempt to develop an oriented solution to said puzzle for said second playing position orientation.

* * * * *